US009865242B2

(12) United States Patent
Espejel

(10) Patent No.: US 9,865,242 B2
(45) Date of Patent: Jan. 9, 2018

(54) SINGLE COIL MULTI-TONE HORNS

(71) Applicant: Ford Global Technologies, LLC, Dearborn, MI (US)

(72) Inventor: Eduardo Trigo Espejel, Mexico (MX)

(73) Assignee: Ford Global Technologies, LLC, Dearborn, MI (US)

( * ) Notice: Subject to any disclaimer, the term of this patent is extended or adjusted under 35 U.S.C. 154(b) by 108 days.

(21) Appl. No.: 14/829,903

(22) Filed: Aug. 19, 2015

(65) Prior Publication Data

US 2017/0053632 A1 Feb. 23, 2017

(51) Int. Cl.
*H04R 25/00* (2006.01)
*G10K 9/13* (2006.01)

(52) U.S. Cl.
CPC ..... *G10K 9/13* (2013.01)

(58) Field of Classification Search
CPC ..... G10K 9/13; B60Q 5/008; H04R 5/033; H04R 5/0335
USPC ..... 340/384.1, 384.5, 384.71, 391.1; 381/62, 381/185, 186; 379/438, 443
See application file for complete search history.

(56) References Cited

U.S. PATENT DOCUMENTS

| | | | | |
|---|---|---|---|---|
| 3,453,570 A | | 7/1969 | Clements | |
| 4,005,267 A | * | 1/1977 | Gorike | G10H 1/04 381/62 |
| 4,241,334 A | * | 12/1980 | Shintaku | B06B 1/0269 340/388.1 |
| 4,361,952 A | * | 12/1982 | Neese | G10K 9/15 116/142 R |
| 8,598,997 B2 | | 12/2013 | Hayashi et al. | |

FOREIGN PATENT DOCUMENTS

| | | | |
|---|---|---|---|
| GB | 178428 | A | 12/1922 |
| GB | 913536 | A | 12/1962 |
| JP | 2013222126 | A | 10/2013 |

* cited by examiner

*Primary Examiner* — Davetta W Goins
*Assistant Examiner* — Phylesha Dabney
(74) *Attorney, Agent, or Firm* — Frank MacKenzie; Brooks Kushman P.C.

(57) ABSTRACT

A vehicle includes a horn assembly disposed behind a grille. The horn assembly includes a coil configured to generate a magnetic field in response to a current, a first diaphragm connected to a first plunger, a second diaphragm connected to a second plunger, and a spring. The spring is connected to the first and second plungers such that oscillation is transferred from the first diaphragm to the second diaphragm through the spring in response to the magnetic field from the coil.

16 Claims, 3 Drawing Sheets

SINGLE COIL MULTI-TONE HORNS

TECHNICAL FIELD

The present disclosure relates to dual tone electromagnetic horns for vehicles.

BACKGROUND

Vehicles use horns to alert other drivers of the presence of the vehicle. When an operator actuates the horn, current is applied to an electromagnet creating an attractive electromagnetic force on a plunger and diaphragm assembly. As the diaphragm is attracted toward the electromagnet, a switch is activated and disconnects the electromagnet from the current. Disconnecting the current from the electromagnet allows the diaphragm to move back to its initial position. As the diaphragm moves back to its initial position, the switch deactivates and current is again applied to the electromagnet. Continual oscillation of the diaphragm, through connecting and disconnecting current to the electromagnet, creates a sound emitted through the horn.

SUMMARY

An electromagnetic horn includes a first plunger and diaphragm assembly, a second plunger and diaphragm assembly, an electromagnetic coil, and a spring. The spring interconnects the first and second assemblies such that oscillation of the first assembly in a presence of a changing electromagnetic field generated by the coil drives oscillation of the second assembly to create a dual tone sound. A first diaphragm of the first plunger and diaphragm assembly may have a spring constant greater than a spring constant of a second diaphragm of the second plunger and diaphragm assembly. A constant of the spring may be less than a constant of a first diaphragm of the first plunger and diaphragm assembly to decrease a frequency response of the second plunger and diaphragm assembly. The spring may also decrease a frequency response of the second plunger and diaphragm assembly. A first plunger of the first plunger and diaphragm assembly may have a mass greater than a mass of a second plunger of the second plunger and diaphragm assembly to increase a frequency response of the first assembly. The electromagnetic horn may further include a snail disposed between the first and second plunger and diaphragm assemblies and configured to emit sound from the first and second plunger and diaphragm assemblies.

A horn system for a vehicle includes a housing, a single electromagnetic coil, a first diaphragm, a second diaphragm, and a biasing member. The housing has first and second sounding snails disposed behind a grille. The single electromagnetic coil is disposed within the housing. The first diaphragm is attached to a first mass adjacent the electromagnetic coil. The second diaphragm is attached to a second mass. The biasing member is disposed between and connected to the first and second diaphragms such that, in response to a magnetic field generated by the coil, oscillation of the first diaphragm causes oscillation of the second diaphragm to emit sound from the snails.

A vehicle includes a horn assembly disposed behind a grille. The horn assembly includes a coil configured to generate a magnetic field in response to a current, a first diaphragm connected to a first plunger, a second diaphragm connected to a second plunger, and a spring. The spring is connected to the first and second plungers such that oscillation is transferred from the first diaphragm to the second diaphragm through the spring in response to the magnetic field from the coil. The first diaphragm may be a spring membrane. The second diaphragm may also be a spring membrane. A frequency of oscillation of the first diaphragm may be greater than a frequency of oscillation of the second diaphragm.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
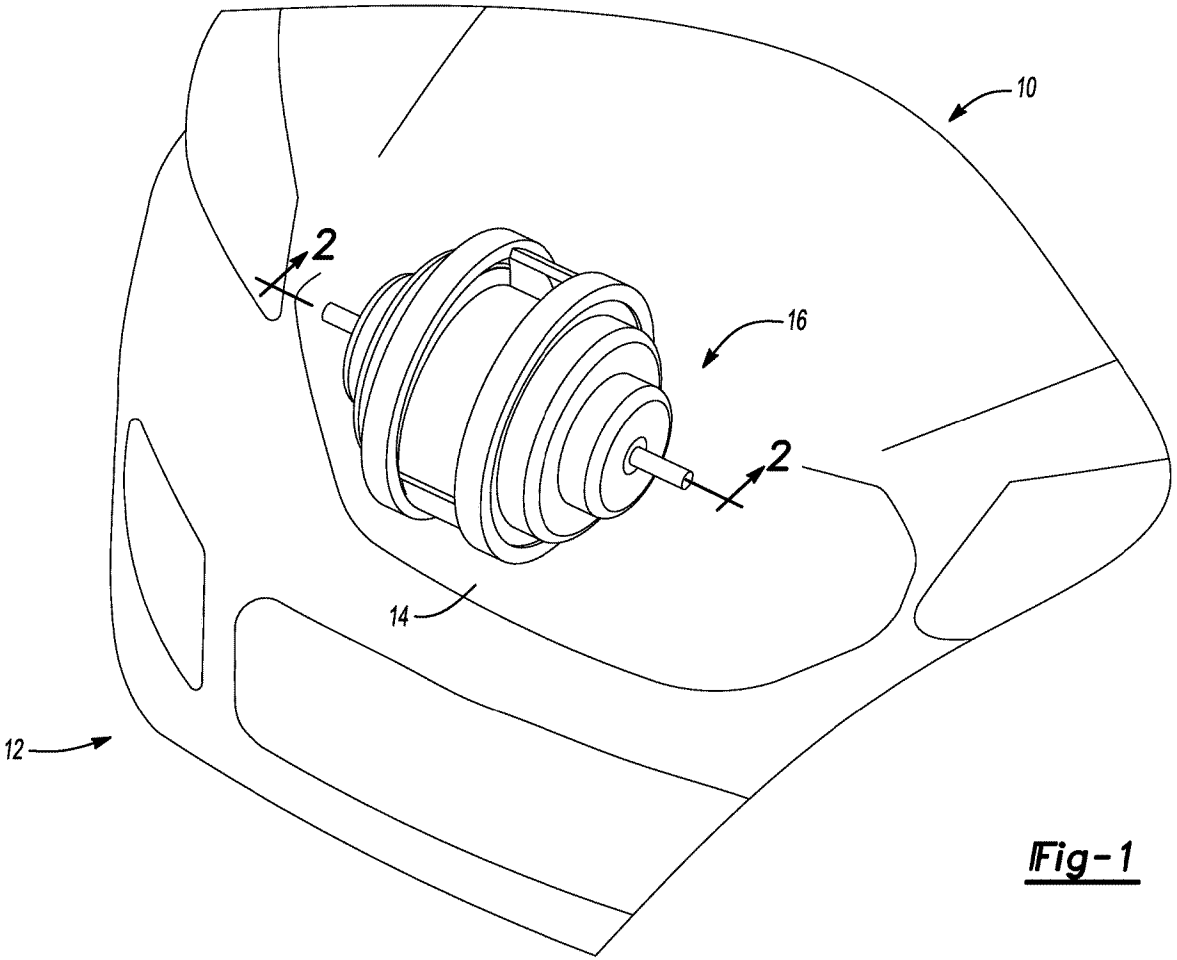
FIG. 1 is a partial perspective view of an electromagnetic horn within a grille of a front end of a vehicle.

FIG. 1 is a partial perspective view of a vehicle 10. The vehicle 10 includes a front end 12 having a grille 14. The grille 14 may include a horn assembly 16. The horn assembly 16 may attach to the grille 14 using mounting brackets (not shown).

Figure 2:
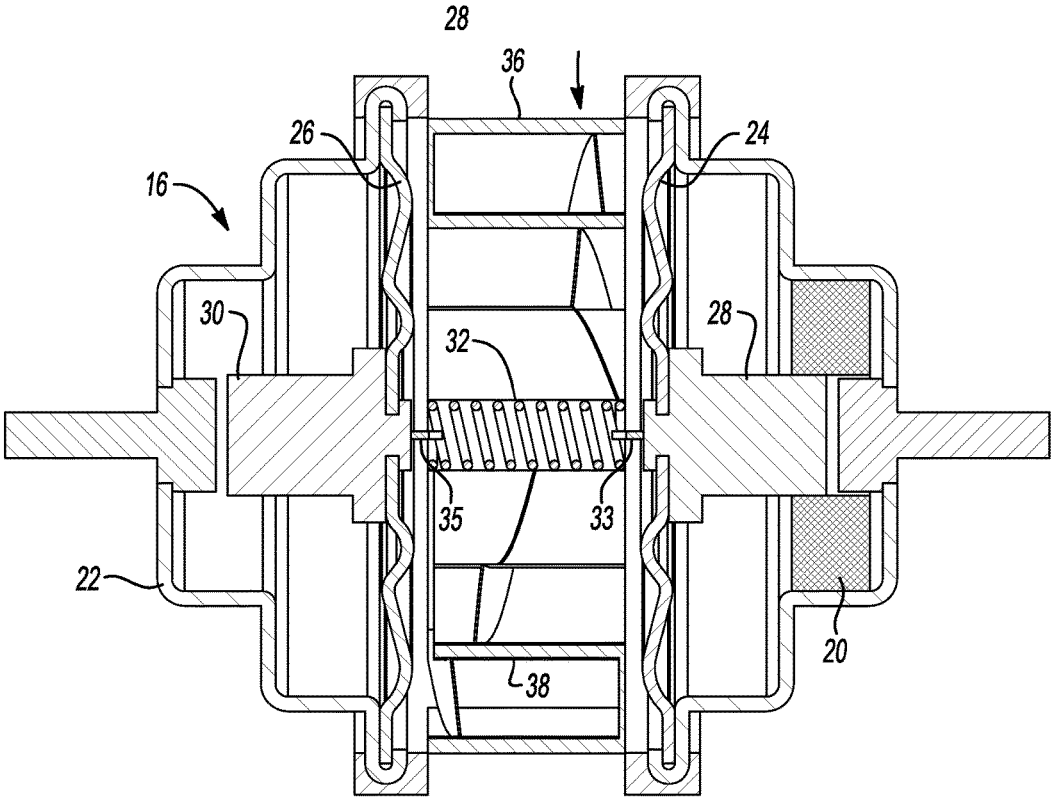
FIG. 2 is a cross-section taken along lines 2-2 of FIG. 1 of the electromagnetic dual-tone horn.

FIG. 2 depicts a cross-sectional view of electromagnetic horn assembly 16 taken along the lines 2-2 of FIG. 1. The horn assembly 16 may be an electromagnetic actuated horn contained within a housing 22. For example, the electromagnetic horn assembly 16 uses a first plunger 28, electromagnetic coil 20, and a first diaphragm 24. Once a current is applied to the electromagnetic coil 20, the electromagnetic coil 20 produces a magnetic flux that attracts the first plunger 28, which pulls on the first diaphragm 24. The first plunger 28 pulls the first diaphragm 24 to the maximum load dependent on a spring constant of the diaphragm 24. At the spring constant maximum load of the first diaphragm 24, a switch (not shown) is disconnected and current is no longer applied to the electromagnetic coil 20. When current is not applied to the electromagnetic coil 20, the electromagnetic coil 20 stops generating magnetic flux and the first plunger 28 returns to the starting position, oscillating the first diaphragm 24. The first diaphragm 24 returns to the initial position and the switch (not shown) reconnects and the process starts over. The electromagnetic horn 16 allows for continuous oscillation of the first diaphragm 24. A biasing member 32 interconnects the first diaphragm 24 with a second diaphragm 26. The biasing member 32 allows for oscillation of the first and second diaphragms 24, 26 in order to produce a sound that emanates from the electromagnetic horn 16. The first diaphragm 24 and the second diaphragm may be spring membranes.

The electromagnetic horn assembly 16 attaches to the grille 14 and is configured to oscillate multiple diaphragms 24, 26 to produce two different tones from the electromagnetic horn 16. The electromagnetic horn assembly 16 uses a single electromagnetic coil 20 to oscillate the first diaphragm 24 and the second diaphragm 26. The diaphragms 24, 26 are attached to the first plunger 28 and a second plunger 30. The first plunger 28 attaches to the second plunger 30 using the biasing member 32. The biasing member 32 attaches to the first plunger 28 at a first end 33 of the biasing member 32. Likewise, the biasing member 32 attaches to the second plunger 30 at a second end 35 of the biasing member 32.

When current is applied to the electromagnetic coil 20, the electromagnetic coil 20 generates a magnetic flux that attracts the first plunger 28 as described above. The force from the electromagnetic coil 20 is transferred through the first plunger 28 using the biasing member 32. Pulling the first plunger 28 toward the electromagnetic coil 20 stretches the biasing member 32 in the direction of the electromagnetic coil 20, which pulls the second plunger 30 at the second end 35 of the biasing member 32. Pulling the second plunger 30 pulls the second diaphragm 26 and oscillates the second diaphragm 26. The biasing member 32 may be a spring.

The spring constant of the biasing member 32 is chosen based on the amount of flux generated by the electromagnetic coil 20, the spring constant of the first diaphragm 24, the spring constant of the second diaphragm 26, the mass of the first plunger 28, and the mass of the second plunger 30. For example, the mass of the first plunger 28 may be greater than the mass of the second plunger 30. And the spring constant of the biasing member 32 may be less than spring constant of the first diaphragm 24 and the second diaphragm 26. Likewise, the first diaphragm 24 may have a spring constant greater than a spring constant of the second diaphragm 26. If the spring constant of the first diaphragm 24 is greater than a spring constant of the second diaphragm 26, the first diaphragm 24 may oscillate at a frequency greater than the frequency of the second diaphragm 26 due to the increased stiffness of the first diaphragm 24.

Adjusting the masses of the first and second plungers 28, 30, and the spring constants of the first diaphragm 24, the second diaphragm 26, and the biasing member 32 allows the first diaphragm 24 to oscillate at a first frequency and the second diaphragm 26 to oscillate at a second frequency. Oscillating the first and second diaphragms 24, 26 at different frequencies allows electromagnetic horn assembly 16 to emit multiple tones using a single electromagnetic coil 20. Producing dual tones from the electromagnetic horn assembly 16 with a single electromagnetic coil 20 improves performance of the vehicle 10. For example, by using less current to activate electromagnetic horn assembly 16 to further produce desired results, the vehicle battery 13 may store more power. The additional charge saved by the battery 13 may be used in other vehicle systems, such as powering the electric machine, or any other system that allows for improved performance. Also by connecting the first diaphragm 24 and the second diaphragm 26 using the biasing member 32, a switch (not shown) to oscillate the second diaphragm 26 may be eliminated. Eliminating a switch to oscillate the second diaphragm 26 reduces the amount of moving parts within the electromagnetic horn assembly 16 and increases durability of the electromagnetic horn assembly 16.

A snail 34 may be placed between the first diaphragm 24 and the second diaphragm 26 and adjacent the biasing member 32. The snail 34 is configured to emit sound caused by oscillation of the first diaphragm 24 and the second diaphragm 26. The snail 34 may be placed in the center of the electromagnetic horn assembly 16. The snail 34 may also be placed anywhere within the electromagnetic horn assembly 16 which allows the snail 34 to emanate both tones caused by oscillation of the first diaphragm 24 at a first frequency and the second diaphragm 26 at a second frequency. The snail 34 may also be a double snail 34. The double snail 34 may include a first snail 36 and a second snail 38. The first snail 36 and the second snail 38 may be disposed between the first diaphragm 24 and the second diaphragm 26 within the electromagnetic horn assembly 16. In a double snail configuration, the first snail 36 and the second snail 38 may also be intertwined. Likewise, the first snail 36 and the second snail 38 may be arranged such that the first and second diaphragms 24, 26 are between the first and second snails 36, 38.

Figure 3:
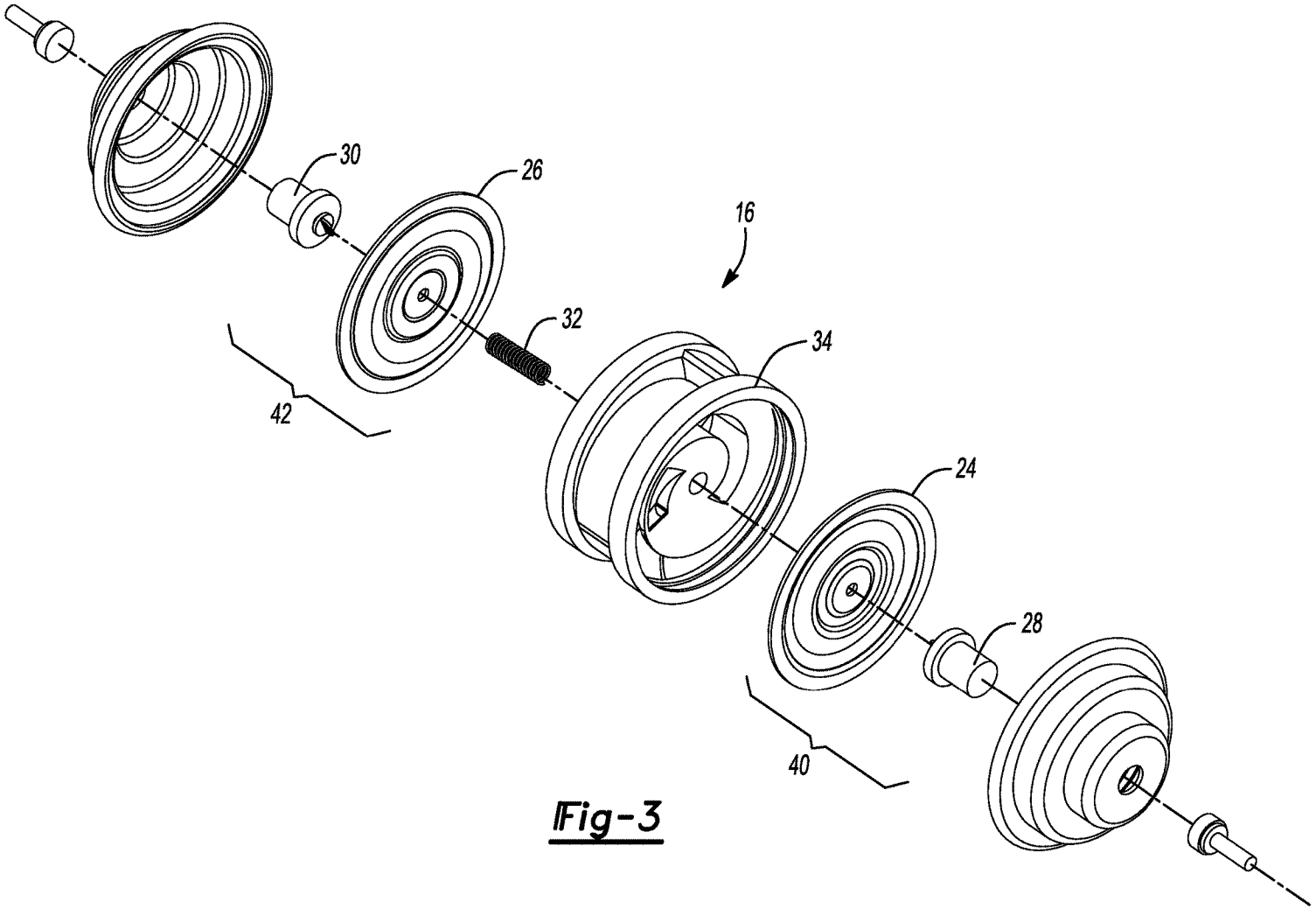
FIG. 3 is an exploded view of the electromagnetic dual-tone horn for the vehicle.

FIG. 3 depicts an exploded view of electromagnetic horn assembly 16. The first plunger 28 and the first diaphragm 24 may form a first assembly 40. The second plunger 30 and the second diaphragm 26 may form a second assembly 42. The biasing member 32, or spring, then interconnects the first assembly 40 and the second assembly 42. Therefore, the spring constant of the biasing member 32 influences the frequency response of the first assembly 40 and the second assembly 42. For example, as a spring constant of the biasing member 32 increases, the frequency response of the second assembly 42 decreases.

Similarly, a mass of the first plunger 28 within the first assembly 40 may also influence the frequency response of the first assembly 40 and the second assembly 42. A larger mass of the first assembly 40 may be attracted toward the electromagnetic coil 20 at a different rate than a smaller mass of the first assembly 40 due to interaction between the first assembly 40 and the electromagnetic flux. For example, the first plunger 28 may have a mass greater than the mass of the second assembly 42 to decrease the frequency response of the first diaphragm 24. Increasing and decreasing the frequency responses of the first diaphragm 24 and the second diaphragm 26 further allows the electromagnetic horn assembly 16 to emanate sounds through the snail 34 at different frequencies allowing for multiple tones.

As can be seen in the exploded view of FIG. 3, the snail 34 may be disposed between the first assembly 40 and the second assembly 42. Placing the snail 34 between the first assembly 40 and the second assembly 42 allows the snail to emit sound from the first assembly 40 and the second assembly 42. As stated above, the first assembly 40 may include the first plunger 28 and the first diaphragm 24, in which the first diaphragm 24 may be adhered, bonded, or welded to the first plunger 28. Likewise, the second assembly 42 may include the second plunger 30 and the second diaphragm 26, in which the second diaphragm 26 may be adhered, bonded, or welded to the second plunger 30.

As described above, the first assembly 40 and the second assembly 42 are interconnected using the biasing member 32. The biasing member 32 may be a tuned spring. Therefore, the biasing member 32 may act as a tuned mass damper to stabilize the oscillatory motion between the first assembly 40 and the second assembly 42. For example, based on the varying characteristics of either the first diaphragm 24 or the first plunger 28 of the first assembly 40, the biasing member 32 may be configured to reduce vibrations transferred from the first assembly 40 to the second assembly 42. By reducing the vibrations transferred from the first assembly 40 to the second assembly 42, the second diaphragm 26 of the second assembly 42 may oscillate at a different frequency less than a frequency of oscillation of the first diaphragm 24. The differing oscillations between the first diaphragm 24 and the second diaphragm 26, due to the biasing member 32 acting as a tuned mass damper, allows the electromagnetic horn assembly 16 to be a dual tone electromagnetic horn assembly 16.

The tones produced by the first assembly 40 and the second assembly 42 are therefore impacted by the spring constant of the biasing member 32. The biasing member 32 with a lower spring constant may dampen the resonating frequency of the first assembly 40 as it transfers to the second assembly 42 less than a biasing member 32 with a higher spring constant. For example, using a biasing member 32 having a low spring constant may cause the second assembly 42 to have a frequency much lower than the frequency of the first assembly 40. Likewise, using a biasing member 32 with a higher spring constant may cause the second assembly 42 to have a frequency much higher than the frequency of the first assembly 40. Therefore, the biasing member 32 may be designed such that the first assembly 40 and the second assembly 42 oscillate at optimal frequencies to allow maximum performance of a dual-tone electromagnetic horn assembly 16. The electromagnetic horn assembly 16 may be configured to produce two tones based on optimization of the biasing member 32, the first assembly 40, the second assembly 42, or by optimizing the characteristics of the biasing member 32, the first assembly 40, or the second assembly 42.

While exemplary embodiments are described above, it is not intended that these embodiments describe all possible forms encompassed by the claims. The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. An electromagnetic horn comprising:

first and second plunger and diaphragm assemblies having first and second diaphragms, the first diaphragm having a spring constant greater than a spring constant of the second diaphragm;

an electromagnetic coil; and a spring interconnecting the first and second assemblies such that oscillation of the first assembly in a presence of a changing electromagnetic field generated by the coil drives oscillation of the second assembly to create a dual tone sound.

2. The electromagnetic horn of claim 1, wherein a constant of the spring is less than a constant of a first diaphragm of the first plunger and diaphragm assembly to decrease a frequency response of the second plunger and diaphragm assembly.

3. The electromagnetic horn of claim 1, wherein the spring decreases a frequency response of the second plunger and diaphragm assembly.

4. The electromagnetic horn of claim 1, wherein a first plunger of the first plunger and diaphragm assembly has a mass greater than a mass of a second plunger of the second plunger and diaphragm assembly to increase a frequency response of the first assembly.

5. The electromagnetic horn of claim 1 further comprising a snail disposed between the first and second plunger and diaphragm assemblies configured to emit sound from the first and second plunger and diaphragm assemblies.

6. A horn system for a vehicle comprising:

a housing having first and second sounding snails disposed behind a grille;

a single electromagnetic coil disposed within the housing;

a first diaphragm attached to a first mass adjacent the electromagnetic coil;

a second diaphragm attached to a second mass; and a biasing member spring having a constant being less than a spring constant of the first and second diaphragms and disposed between and connected to the first and second diaphragms such that, in response to a magnetic field generated by the coil, oscillation of the first diaphragm causes oscillation of the second diaphragm to emit sound from the snails.

7. The horn system of claim 6, wherein the first and second sounding snails are intertwined.

8. The horn system of claim 6, wherein the first and second sounding snails are disposed between the first and second diaphragms.

9. The horn system of claim 6, wherein the first and second sounding snails are arranged such that the first and second diaphragms are between the first and second sounding snails.

10. The horn system of claim 6, wherein the first diaphragm oscillates at a first frequency and the second diaphragm oscillates at a second frequency.

11. The horn system of claim 10, wherein the first frequency is greater than the second frequency.

12. The horn system of claim 10, wherein the first frequency generates a first tone and the second frequency generates a second tone.

13. A vehicle comprising:

a horn assembly disposed behind a grille and including, a coil configured to generate a magnetic field in response to a current, a first diaphragm connected to a first plunger, a second diaphragm connected to a second plunger, and a spring having a constant being less than a spring constant of the first and second diaphragms and connected to the first and second plungers such that oscillation is transferred from the first diaphragm to the second diaphragm through the spring in response to the magnetic field from the coil, wherein a frequency of oscillation of the first diaphragm is greater than a frequency of oscillation of the second diaphragm.

14. The vehicle of claim 13, wherein a mass of the first plunger is greater than a mass of the second plunger.

15. The vehicle of claim 13, wherein the first diaphragm is a spring membrane.

16. The vehicle of claim 13, wherein the second diaphragm is a spring membrane.

* * * * *